US010218119B2

(12) United States Patent
Williams

(10) Patent No.: US 10,218,119 B2
(45) Date of Patent: Feb. 26, 2019

(54) ELECTRICAL CONNECTION SYSTEM FOR USE IN HIGH POWER APPLICATIONS

(71) Applicant: CONNEC LIMITED, Rushcutters Bay, New South Wales (AU)

(72) Inventor: Stephen Williams, Rushcutters Bay (AU)

(73) Assignee: Connec Limited, Rushcutters Bay, New South Wales (AU)

( * ) Notice: Subject to any disclaimer, the term of this patent is extended or adjusted under 35 U.S.C. 154(b) by 0 days.

(21) Appl. No.: 15/759,258

(22) PCT Filed: Sep. 10, 2015

(86) PCT No.: PCT/AU2015/000563
§ 371 (c)(1),
(2) Date: Mar. 12, 2018

(87) PCT Pub. No.: WO2017/041128
PCT Pub. Date: Mar. 16, 2017

(65) Prior Publication Data

US 2018/0254582 A1 Sep. 6, 2018

(51) Int. Cl.
*H01R 13/62* (2006.01)
*H01R 13/629* (2006.01)
(Continued)

(52) U.S. Cl.
CPC ..... *H01R 13/62977* (2013.01); *H01R 13/53* (2013.01); *H01R 24/20* (2013.01); *H01R 24/28* (2013.01); *H01R 2105/00* (2013.01)

(58) Field of Classification Search
CPC ..... H01R 24/20; H01R 13/62977; H01R 13/5205; H01R 13/5208; H01R 13/53; H01R 31/02
(Continued)

(56) References Cited

U.S. PATENT DOCUMENTS 3,851,296 A 11/1974 Muchmore et al.
4,083,619 A 4/1978 McCormick et al.
(Continued)

FOREIGN PATENT DOCUMENTS

WO 2016011474 1/2016
WO 2016011475 1/2016
(Continued)

OTHER PUBLICATIONS

International Search Report for Application No. PCT/AU2015/000563 dated Oct. 1, 2015 (3 pages).
(Continued)

*Primary Examiner* — Jean F Duverne
(74) *Attorney, Agent, or Firm* — Michael Best & Friedrich LLP

(57) ABSTRACT

An electrical connection system is described. The electrical connection system comprises a first electrical connection component that is suitable for transmission of power with a voltage level greater than 1 kV. The electrical connection system also comprises a second electrical connection component that is suitable for transmission of power with a voltage level greater than 1 kV and arranged for coupling to the first electrical connection component. The electrical connection system comprises a mechanical coupling assembly for imparting a driving force to drive the first and second electrical connection components relative to each other along a central axis of the electrical connection system and between disengaged and engaged conditions. The mechanical coupling assembly is structured to impart a portion of the driving force at a first eccentric position and comprising a transmission that is arranged to transmit a further portion of the driving force to a second eccentric position. The second eccentric position has an angular orientation around the
(Continued)

central axis that is different to that of the first eccentric position.

15 Claims, 4 Drawing Sheets

(51) Int. Cl.
*H01R 13/53* (2006.01)
*H01R 105/00* (2006.01)
*H01R 24/20* (2011.01)
*H01R 24/28* (2011.01)

(58) Field of Classification Search
USPC ..... 439/157
See application file for complete search history.

(56) References Cited

U.S. PATENT DOCUMENTS 4,415,217 A * 11/1983 Clabburn ..... H01R 31/02 439/488
4,892,488 A * 1/1990 Nestor ..... H01R 24/20 439/438
4,981,446 A * 1/1991 Lazaro, Jr. ..... H01R 13/5208 439/275
4,986,764 A * 1/1991 Eaby ..... H01R 13/53 439/275
5,595,500 A 1/1997 Page
5,626,486 A * 5/1997 Shelly ..... H01R 13/53 439/273
5,906,513 A * 5/1999 Peterson ..... H01R 9/032 439/320
8,382,508 B1 * 2/2013 Frey ..... H01R 13/5205 174/84 R
8,696,376 B2 * 4/2014 Andresen ..... H01R 4/2433 439/391

FOREIGN PATENT DOCUMENTS

WO 2016011476 1/2016
WO 2016011477 1/2016

OTHER PUBLICATIONS

International Preliminary Report on Patentability for Application No. PCT/AU2015/000563 dated Dec. 11, 2015 (11 pages).

* cited by examiner

ELECTRICAL CONNECTION SYSTEM FOR USE IN HIGH POWER APPLICATIONS

FIELD OF THE INVENTION

The present invention relates to an electrical connection system for use in high power applications. In particular, though not exclusively, the present invention relates to an electrical connection system suitable for use in high power applications in demanding environments such as the petroleum or mining industry.

BACKGROUND OF THE INVENTION

Reliable electrical connections are crucial in high power applications, such as powering of heavy electrical machinery often used in the mining or petroleum industry. In these applications the electrical cables transmit high currents at voltages of one or more kV.

Typical electrical connectors used in the art have a plurality of pins or sockets, each being connected to a respective core of an electrical cable. Depending on the specific application, the connectors must comply with specific requirements or standards. The compliance of the connectors with the relevant standards is examined by a certifying body.

In an explosive environment, for example, particular precaution must be taken and a flame path may be required between connectors to reduce likelihood of explosions. The flame path typically is formed between a plug and a receptacle by positioning a cylindrical surface that surrounds contacts and/or electrical leads of the plug inside a respective surface of a receptacle. The mechanical tolerance between the cylindrical surfaces is fine (typically 0.2 to 0.4 mm). As a consequence of the fine mechanical tolerance, canting or seizing may occur which makes it difficult to engage or disengage the plug and the receptacle form each other.

SUMMARY OF THE INVENTION

In a first aspect of the present invention there is provided an electrical connection system that comprises:

a first electrical connection component that is suitable for transmission of power with a voltage level greater than 1 kV;

a second electrical connection component that is suitable for transmission of power with a voltage level greater than 1 kV and arranged for coupling to the first electrical connection component;

wherein the electrical connection system comprises a mechanical coupling assembly for imparting a driving force to drive the first and second electrical connection components relative to each other along a central axis of the electrical connection system and between disengaged and engaged conditions, the mechanical coupling assembly being structured to impart a portion of the driving force at a first eccentric position and comprising a transmission that is arranged to transmit a further portion of the driving force to a second eccentric position, the first and second eccentric positions having respective angular orientations around the central axis.

The mechanical coupling assembly may be arranged to distribute the driving force in substantially equal portions exclusively to spaced apart eccentric positions having respective angular orientations around the central axis. In one embodiment the mechanical coupling assembly is arranged to distribute the driving force to two spaced apart positions, such as two eccentric positions that are opposite each other.

The mechanical coupling assembly may comprise a geared component that may include the transmission and may further comprise a coupling component. The second electrical connection component may comprise the geared component and the first electrical connection component may comprise the coupling component. The coupling component may comprise racks that are positioned to engage with the geared component. The geared component may comprise a ratcheting system. The racks may be distributed at the positions around the central axis and at which drive is in use imparted.

The transmission may have gears that in use transmit a portion of the driving force. In one specific embodiment the transmission comprises gears that are positioned on one side portion of the second electrical connection component and are arranged to distribute portions of the driving force between the first and second eccentric position around the central axis.

In one embodiment the transmission is arranged such that turning of a first gear, for example using the ratcheting mechanism, effects turning of a second remote gear at substantially the same time whereby the portions of the driving force are imparted at the respective first and second positions around axis at substantially the same time and rate.

One of the first and second electrical connection components may comprise pins for engagement with sockets that the other one of the first and second electrical connection components may comprise.

The second electrical connection component is in one specific embodiment a receptacle and the first electrical connection component is a plug arranged for engagement with the receptacle. The geared component with the transmission may form a part of the receptacle. The electrical connection system may further comprise racks that form a part of the plug. The racks may be positioned for engagement with gears of the geared arrangement, which may be arranged to move a connection face of the plug incrementally into the receptacle until the plug is mechanically and electrically coupled with the receptacle.

The first electrical connection component may have a first end for coupling to the second electrical connection component and may be arranged for coupling to a machine cable at a second end.

In one embodiment the second electrical connection component has a first end for coupling to the first electrical connection component and may be arranged for coupling to a machine cable at a second end.

In an alternative embodiment the second electrical connection component has two ends and is arranged for coupling to two first electrical connection components, one at each end. In this embodiment the second electrical connection component may be a receptacle and the first electrical connection components may be plugs. The second electrical connection component may in this embodiment comprise two of the above-described mechanical coupling assemblies each comprising the transmission and arranged for imparting portions of driving forces at at least two eccentric position around the central axis to drive the first electrical connection components relative to the second electrical connection component along the central axis between disengaged and engaged conditions.

The invention will be more fully understood from the following description of specific embodiments of the invention. The description is provided with reference to the accompanying drawings.

DETAILED DESCRIPTION OF SPECIFIC EMBODIMENTS

Embodiments described herein provide an electrical connection system for connecting to machine cables suitable for high power applications. The electrical connection system comprises first and second electrical connection components that are arranged for coupling to each other. For example, the first electrical connection component may be a plug comprising pins and the second electrical connection component may be a receptacle comprising sockets. The electrical connection components are suitable for transmission of power with voltage levels greater than 1 kV (such as 3.3 kV or 11 kV).

The electrical connection system comprises a mechanical coupling assembly for imparting a driving force to drive the first and second electrical connection components relative to each other along a central axis of the electrical connection system between disengaged and engaged conditions. The mechanical coupling assembly is structured to apply a first portion of the driving force at a first eccentric position and comprises a transmission for transmission of a second portion of the driving force to a second eccentric position. The first and second eccentric positions have different angular orientations around the axis.

The mechanical connection assembly further comprises in this embodiment a component (such as a ratcheting system) for applying the driving force manually to the mechanical connection assembly and the transmission then distributes portions of the driving force in substantially equal portions between the first and second eccentric positions around the central axis. The first and second positions are in this embodiment opposite to each other.

The first and second electrical connection components have cylindrical flame path surfaces between which a flame path is defined when the first and second electrical connection components are engaged. The mechanical tolerance between the cylindrical flame path surfaces is 0.2 to 0.4 mm, which is small compared to the relatively large scale of the electrical connection components. As the driving force is distributed to two spaced apart positions around the central axis (in this case opposite positions), the likelihood of mechanical seizing or canting can be reduced when the electrical connection components are moved between the engaged and disengaged conditions along the central axis.

Figure 1:
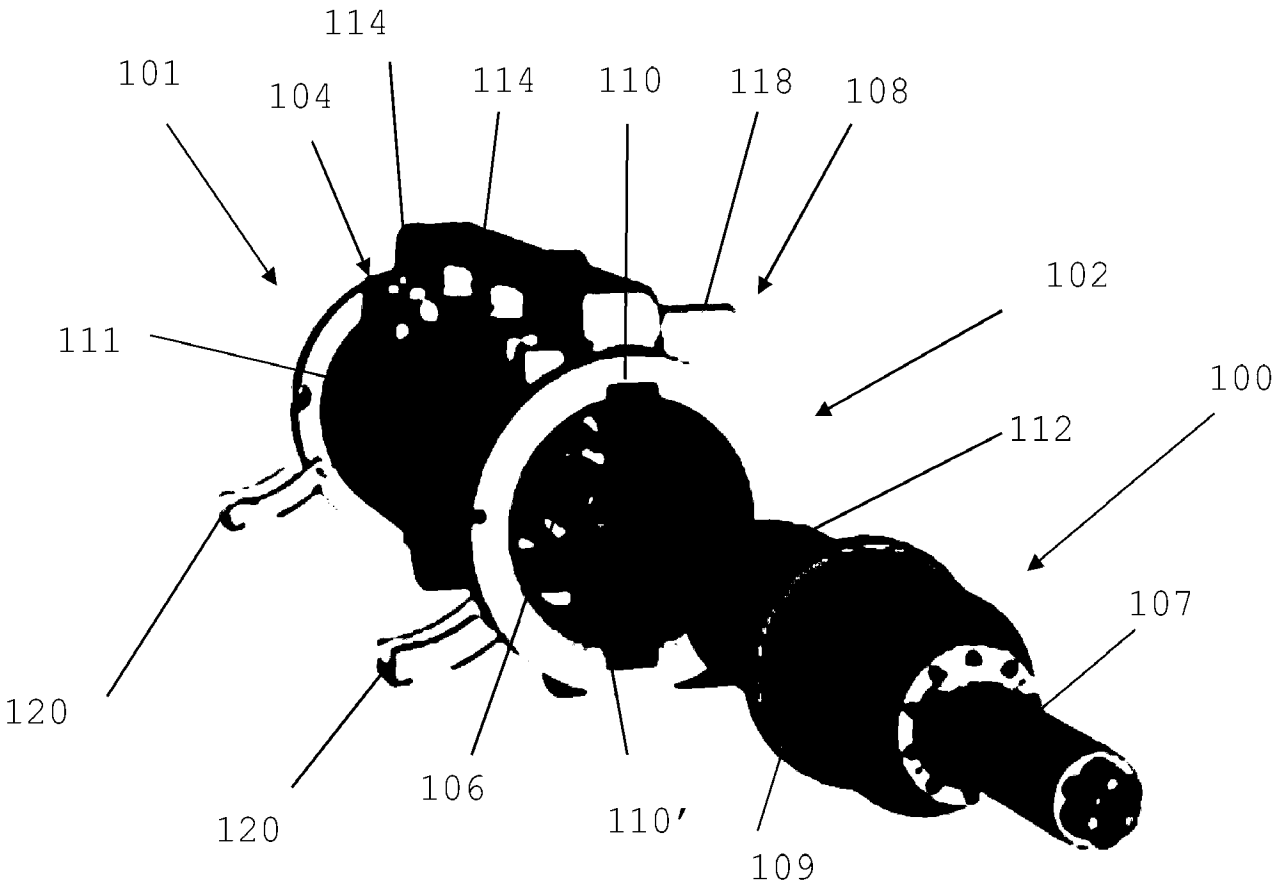
FIGS. 1 and 2 are views of an electrical connection system in accordance with an embodiment of the present invention.
Figure 2:
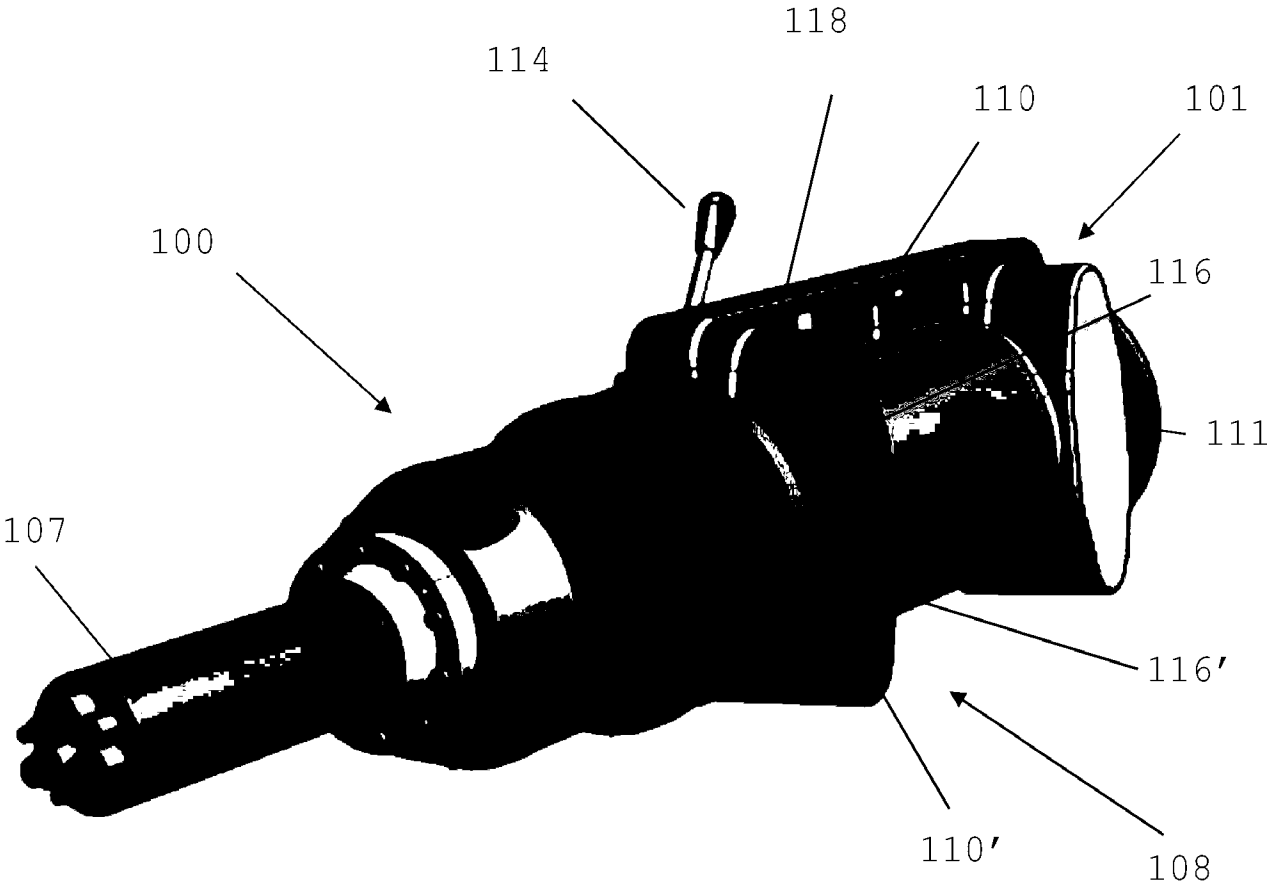

Referring initially to FIGS. 1 and 2, the electrical connection system in accordance with an embodiment of the present invention is now described. FIGS. 1 and 2 show a first electrical connection component that is provided in the form of a plug 100 and is connected to a machine cable 107. Further, FIG. 1 show a second electrical connection component that is provided in the form of a receptacle 101. In this embodiment the receptacle 101 is arranged for coupling to two of the plugs 100 (only one plug 100 is shown), one at each end.

The receptacle 101 and the plug 100 are suitable for transmission of power with a voltage level greater than 1 kV (in this embodiment 3.3 kV). The receptacle 101 and the plug 100 have respective housings 109, 111 that define internal regions. In the embodiment described, the housings 111 and 109 have substantially cylindrical shapes and are formed form a high density polymeric material.

The receptacle 101 has a contact assembly 106 that comprises sockets for electrically connection with pins of a corresponding contact assembly of the plugs 100. In the embodiment described the contact assembly 106 comprises three separate electrical conductors each being arranged in a respective phase tube. The phase tubes comprise an insulating material that surrounds a respective electrical conductor, and a conductive material that surrounds the insulating material and is arranged to be electrically connectable (indirectly) to an earth terminal of a machine cable 107 connected to the plug 100.

The housing 109 of the plug 100 has a machine cable end and a connection end and incorporates the above-mentioned contact assembly (not shown) that has pins and thimbles for connection to respective cores of the machine cable 107. In the embodiment described the contact assembly of the plug 100 comprises three separate electrical conductors each being arranged in a respective phase tube. The phase tubes comprise an insulating material that surrounds a respective electrical conductor, and a conductive material that surrounds the insulating material and is arranged to be electrically connectable to an earth terminal of the machine cable 107.

The receptacle 101 comprises a mechanical connection assembly 108 that has gears and the plug 100 comprises racks 112. For connecting the plug 100 and the receptacle 101 to each other, the plug 100 is urged into the receptacle 101 by use of the mechanical connection assembly 108 that engages with the racks 112. This way the electrical connection assemblies of the plugs 100 couple with the above-described electrical connection assembly 106 within the receptacle 101.

The mechanical connection assembly 108 forms in this embodiment a part of the receptacle 101. However, a person skilled in the art will appreciate that alternatively that mechanical connection assembly 108 may form a part of the plug 100 (in which case the receptacle 101 would comprise the racks 112).

In this example, the mechanical connection assembly 108 comprises gear wheels 110, 110', 116 and 116' (shown in FIG. 4) and the gear wheels 116, 116' form a transmission that transmits drive between the gear wheels 110 and 110'. The gear wheels 110, 110' are arranged to engage in a rack and pinion arrangement with respective racks 112 that are arranged on upper and lower portions of the plug 100 such that, when the gear wheels 110, 110' are turned, the plug 100 is urged into, and retained within, a first end 102 of the receptacle 101.

In this example, the upper gear wheel 110 is turned by a ratchet handle 114. The ratchet handle 114 is coupled to the upper gear wheel 110 in a ratchet configuration such that, when the ratchet handle 114 is moved in a first direction, the upper gear wheel 110 turns, and when the ratchet handle is moved in a second opposite direction the upper gear wheel 110 does not turn.

The gear wheels 110, 110', 116, 116' are housed in a gear housing 118. The gear housing 118 is sealed so as to prevent the ingress of undesirable materials such as dirt and moisture, which may otherwise interfere with the operation of the gear wheels 110, 110', 116, 116'.

Advantageously, and as a result of the gears 116 and 116' the upper and lower gear wheels 110, 110' move in conjunction with one another and substantially simultaneously. As such, the upper and lower racks 112 are moved into the receptacle 101 at substantially the same time and rate. This facilitates uniform movement of the plug 100 into the receptacle 101 and reduces the likelihood of mechanical canting.

The mechanical connection system 108 also comprises a latch 120. The latch 120 can be closed after the plug 100 has been received within the receptacle 101 and is arranged to fit over respective flanges of the first end 102 of the receptacle 101 and the plug 100 so as to retain the plug 100 within the receptacle 101. The latch 120 can be locked in position, for example by using a padlock or similar (not shown).

Although the mechanical connection system 108 has been described above in relation to coupling the plug 100 to the first end 102 of the receptacle 101, it will be appreciated that the second end 104 of the receptacle 101 comprises in this embodiment a correspondingly configured electrical contact assembly and a mechanical connection assembly 108 for mechanically coupling with the second plug (not shown).

In a variation of the above-described embodiment the receptacle 101 may only be arranged for coupling to a plug 100 at the first end 102 and may be arranged for coupling to a machine cable at the second end. In this variation the receptacle 101 is coupled to the machine cable at the second end in the same manner as the plug 100.

Figure 3:
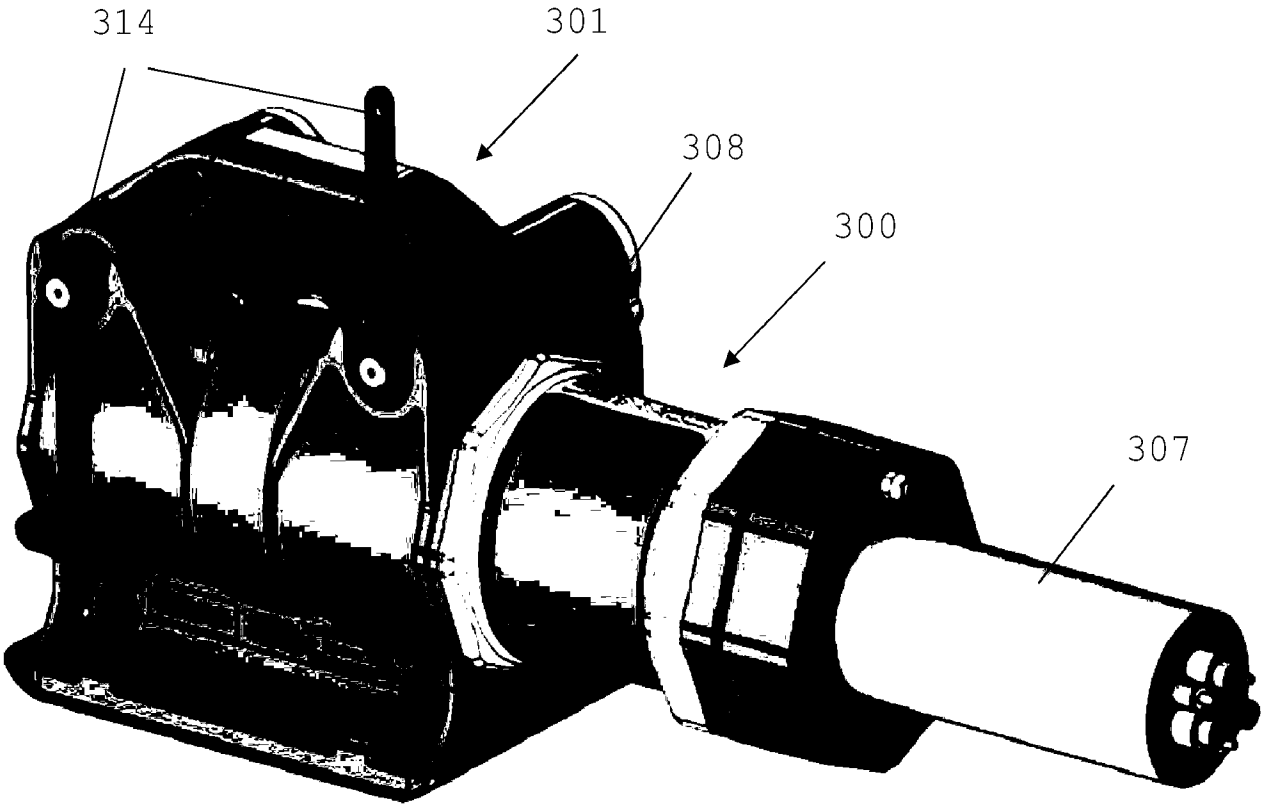
FIG. 3 is a views of an electrical connection system in accordance with an embodiment of the present invention.
Figure 4:
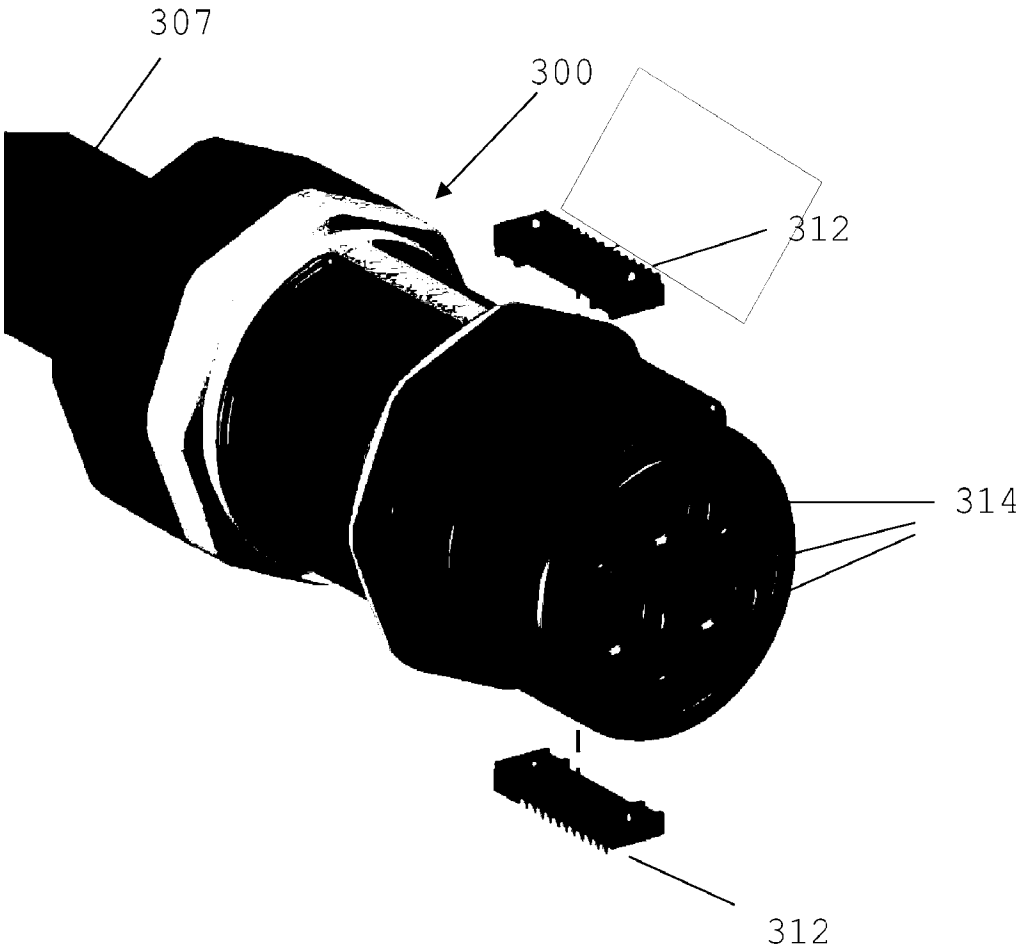
FIG. 4 is view of a component of an electrical connection component in accordance with an embodiment of the present invention.

Referring now to FIG. 4, an electrical connection system in accordance with an alternative embodiment of the present invention is now described. FIG. 3 shows a receptacle 301 and a plug 300 in an engaged condition. The plug 300 and the receptacle 301 are related to the plug 100 and the receptacle 101, respectively, as described above, but have different shapes. The receptacle 301 comprises a mechanical coupling assembly 308 that corresponds to the above-described mechanical coupling assembly 108. The mechanical coupling assembly 308 is operable by leavers 314 of a ratcheting system and distributes a driving force between two opposite eccentric positions around the central axis of the electrical connection system. The receptacle 301 has a housing formed from a high density polymeric material and comprises an electrical coupling assembly for coupling with an electrical coupling assembly of the plug 300.

FIG. 4 shows a front view of components of the plug 300. Shown are racks 312 for engagement with respective gears of the mechanical coupling assembly 208. Further, recesses 314 for receiving electrical conductors and phase tubes are visible.

For further details of electrical contact components reference is being made to the applicant's co-pending PCT international application numbers PCT/AU2014/001077; PCT/AU2014/001076, PCT/AU2014/001082 and PCT/AU2014/001083.

It will be appreciated by persons skilled in the art that numerous variations and/or modifications may be made to the invention as shown in the specific embodiments without departing from the spirit or scope of the invention as broadly described. For example, the electrical connection system may be arranged to impart drive at more than two positions around the central axis of the electrical connection system. Further, the positions at which drive is imparted may not necessarily be opposite positions. For example, drive may be imparted at three eccentric positions that are equally spaced around the central axis using a suitable transmission.

The reference that is being made to the applicant's co-pending PCT international applications does not constitute an admission that the disclosure of the applicant's co-pending PCT international applications is part of the common general knowledge in Australia or any other country.

The invention claimed is:

1. An electrical connection system that comprises:

a first electrical connection component that is suitable for transmission of power with a voltage level greater than 1 kV;

a second electrical connection component that is suitable for transmission of power with a voltage level greater than 1 kV and arranged for coupling to the first electrical connection component;

wherein the electrical connection system comprises a mechanical coupling assembly for imparting a driving force to drive the first and second electrical connection components relative to each other along a central axis of the electrical connection system and between disengaged and engaged conditions, the mechanical coupling assembly being structured to impart a portion of the driving force at a first eccentric position and comprising a transmission that is arranged to transmit a further portion of the driving force to a second eccentric position, the first and second eccentric positions having respective angular orientations around the central axis and wherein the transmission has gears that in use transmit a portion of the driving force and is arranged such that turning of a first gear effects turning of a second remote gear at substantially the same time whereby the portions of the driving force are imparted at the respective first and second eccentric positions around the central axis at substantially the rate and same time.

2. The electrical connection system of claim 1 wherein the mechanical coupling assembly is arranged to distribute the driving force exclusively to two spaced apart eccentric positions having respective angular orientations around the central axis.

3. The electrical connection system of claim 1 wherein the mechanical coupling assembly is arranged to distribute the driving force to two eccentric positions that are substantially opposite each other.

4. The electrical connection system of claim 1 wherein the mechanical coupling assembly comprises a geared component that includes the transmission and further comprises a coupling component.

5. The electrical connection system of claim 4 wherein the second electrical connection component comprises the geared component and the first electrical connection component comprises the coupling component, and wherein the coupling component comprises racks that are positioned to engage with the geared component at positions around the central axis and at which in use drive is in use imparted.

6. The electrical connection system of claim 4 wherein the geared component comprises a ratcheting system.

7. The electrical connection system of claim 1 wherein the transmission comprises gears that are positioned on one side portion of the second electrical connection component and are arranged to distribute portions of the driving force between the first eccentric position and the second eccentric position.

8. The electrical connection system of claim 1 wherein the second electrical connection component is a receptacle and the first electrical connection component is a plug arranged for engagement with the receptacle.

9. The electrical connection system of claim 8 wherein the mechanical connection assembly comprises a geared component with the transmission and forms a part of the receptacle.

10. The electrical connection system of claim 8 further comprising racks that form a part of the plug and wherein the racks are positioned for engagement with gears of the geared arrangement.

11. The electrical connection system of claim 1 wherein the first electrical connection component has a first end for coupling to the second electrical connection component and is arranged for coupling to a machine cable at a second end.

12. The electrical connection system of claim 1 wherein the second electrical connection component has a first end for coupling to the first electrical connection component and is arranged for coupling to a machine cable at a second end.

13. The electrical connection system of claim 1 wherein the second electrical connection component has two ends and is arranged for coupling to two first electrical connection components, one at each end.

14. The electrical connection system of claim 13 wherein the first electrical connection component is one of two first electrical connection components that are plugs and wherein the second electrical connection component is a receptacle.

15. The electrical connection system of claim 14 wherein the mechanical coupling assembly is one of two mechanical coupling assemblies and wherein the second electrical connection component comprises the two mechanical coupling assemblies each comprising a respective transmission and arranged for imparting portions of driving forces at at least two eccentric position around the central axis to drive the first electrical connection components relative to the second electrical connection component along the central axis between disengaged and engaged conditions.

* * * * *